United States Patent [19]

Kim

[11] Patent Number: 4,962,642

[45] Date of Patent: Oct. 16, 1990

[54] AIR FLOW SYSTEM FOR AN INTERNAL COMBUSTION ENGINE

[76] Inventor: Sei Y. Kim, 1564-56 Shinrim 2-Dong,, Kwanak-Ku, Seoul, Rep. of Korea

[21] Appl. No.: 195,888

[22] Filed: May 19, 1988

[51] Int. Cl.[5] ..... F01N 7/00; F02M 29/00

[52] U.S. Cl. ..... 60/272; 123/590

[58] Field of Search ..... 60/272; 123/590

[56] References Cited

U.S. PATENT DOCUMENTS

| | | | |
|---|---|---|---|
| 2,017,043 | 10/1935 | Galliot | 123/590 |
| 3,648,674 | 3/1972 | Proctor | 123/593 |
| 3,877,907 | 4/1975 | Elliff | 123/590 |
| 4,015,574 | 4/1977 | Hanff | 123/590 |
| 4,274,386 | 1/1981 | Reyes | 123/591 |
| 4,309,969 | 1/1982 | Mathes | 123/188 |
| 4,424,777 | 1/1984 | Klomp | 123/188 |
| 4,432,312 | 2/1984 | Klomp et al. | 123/188 |
| 4,539,954 | 9/1985 | Klomp | 123/188 |

FOREIGN PATENT DOCUMENTS

| | | | |
|---|---|---|---|
| 13122 | 1/1983 | Japan | 123/590 |
| 60-17922 | 5/1985 | Japan . | |
| 61-10645 | 3/1986 | Japan . | |

*Primary Examiner*—Douglas Hart

*Attorney, Agent, or Firm*—Birch, Stewart, Kolasch & Birch

[57] ABSTRACT

An air flow system for an internal combustion engine comprising an air cleaner and a swirling device disposed therein having a plurality of vanes for causing the air to swirl thereby improving the properties of the air-fuel mixture and improving the performance of the engine.

7 Claims, 2 Drawing Sheets

AIR FLOW SYSTEM FOR AN INTERNAL COMBUSTION ENGINE

BACKGROUND OF THE INVENTION

1. Field of the Invention

The present invention relates to an air flow system for an internal combustion engine and more particularly, to an air swirling device having a plurality of vanes positioned within an air cleaner of an internal combustion engine for achieving complete combustion. The air flow system is used for a spark ignition internal combustion of a carburetor type or a fuel injection type, and a diesel engine of a high compression self-ignition type.

2. Brief Description of the Prior Art

It is known that an increase of swirl flow in a combustion chamber of an internal combustion engine improves the flame propagation speed so that complete combustion is achieved. However, there are many problems which accompany attempts at increasing air flow such as air resistance and the like. Such known facts are shown in the following prior art documents. For example, Japanese patent publication Nos. 53-26247, 59-11722, and U.S. Pat. No. 4,309,969 disclose a simple turbulence device, which includes an intake valve having a large intake resistance so that the swirling device does not create an uniform air flow. Japanese patent publication Nos. 60-17922 and 61-10645, U.S. Pat. Nos. 4,424,777, 4,432,312, and 4,539,954 disclose a device having vanes which are disposed at the vicinity of an intake valve. Such devices have various disadvantages, such as for example, air resistance, reduced inlet air into the cylinder, varying air flows of intake manifolds and strong vibrations due to different swirl ratios and volumes of intake air. U.S. Pat. Nos., 3,648,674 and 4,274,386 disclose a wire set and blades device disposed between a carburetor and a intake manifold. However, the device exhibits high friction so that the device provides a reduced amount of inlet air and is used only for a gasoline engine of the carburetor type.

SUMMARY OF THE INVENTION

Accordingly, it is an object of the present invention to provide an improved air flow system for an internal combustion engine.

Another object of the present invention is to provide an air swirling device located in an air cleaner, the air swirling device having a plurality of vanes.

One advantage of the air swirling device of the present invention is that it minimizes the restriction of air flow and causes the fuel to stay in the center part of the swirl of air and prevents adherence of the fuel to the wall of the intake system. This provides for a good mixture of air and fuel having good evaporation and fine and uniform fuel particle size which improves the acceleration of the vehicle driven by the engine. If there is a slight pedal acceleration, the amount of the injected fuel is lower thereby resulting in fuel savings.

During operation, the air intake valve continuously opens and closes. When the valve is closed a revolution inertia force causes a high density of air which surge into the combustion chamber when the valve opens. During combustion, the flame is scattered and the fuel is completely combusted thereby producing a uniform force downwardly on the piston. The uniform force prevents noise vibration and abrasion thereby causing stronger engine power and longer engine life. The fast combustion is useful with advanced spark timing and results in leaner combustion, lower air pollution and fuel savings. The combustion products (carbon and oxides) are concentrated in the center of the combustion chamber and can be easily exhausted to prevent carbon accumulation in the combustion chamber which could cause engine abrasion. The swirling action may continue in the same direction as the gas leaves the combustion chamber. When the swirling device is placed in the air cleaner, the carbon monoxide (CO) gas level can be reduced up to 20% at engine idle speed. The engine power can be increased up to 8%. Fuel economy can be improved up to 4% and $NO_X$ can be reduced up to 8%. These data were calculated and measured by the Korea National Industry Research Institute.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to an air flow system for an internal combustion engine comprising an air cleaner and a swirling device having a plurality of vanes which are disposed around the center of the air cleaner for causing the air to swirl. The air cleaner preferably has a cylindrical shape and the swirling device has a control outwardly from the control area toward the air cleaner. The vanes of the swirling device may be formed of a flexible material which flexes in response to increased air flow through the air cleaner to reduce the air resistance.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
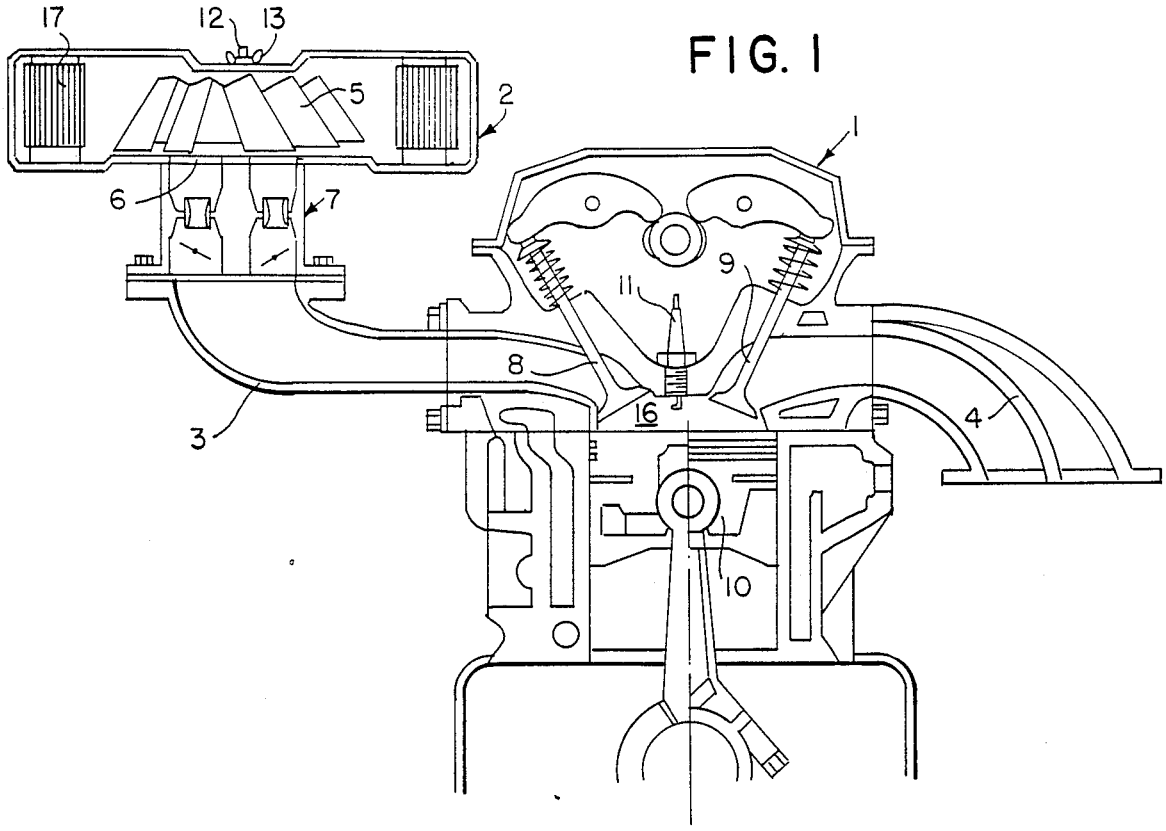
FIG. 1 is a cross-sectional view of the air flow system for a gasoline engine of an internal combustion engine of the present invention.
Figure 2:
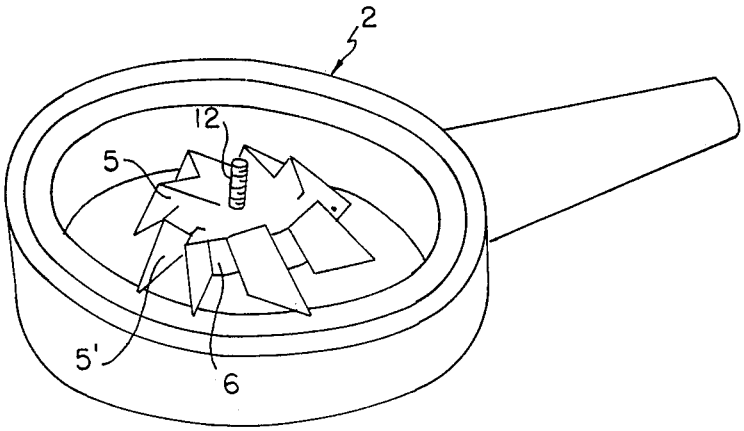
FIG. 2 is a perspective view of an air cleaner containing a swirling device of the present invention.
Figure 3:
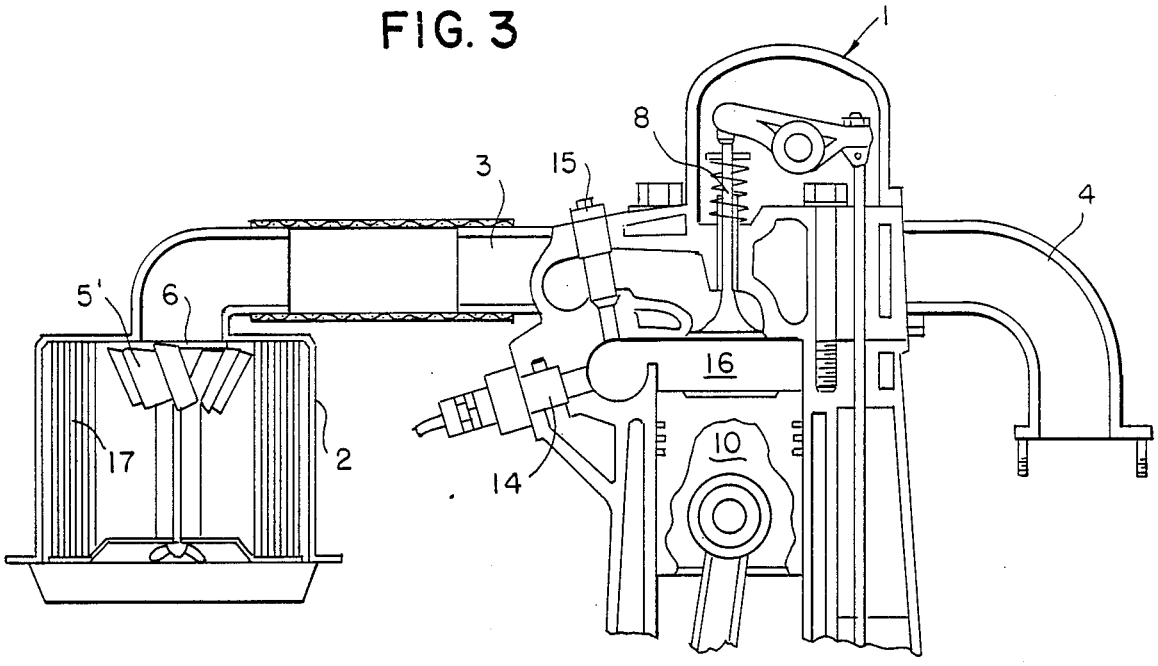
FIG. 3 is a cross-sectional view of the air flow system for a diesel engine of an internal combustion engine.

Referring now in detail to the drawings for the purpose of illustrating preferred embodiments of the present invention, the air flow system as shown in FIGS. 1, 2 and 3 comprises an air cleaner 2 and a swirling device 5 having a plurality of vanes 5' which is disposed around the center of the air cleaner 2 for causing the air to swirl.

The air cleaner 2 is associated with an engine body 1 of a gasoline engine through a carburetor 7 and an intake manifold 3 (FIG. 1). The engine body 1 is associated with an exhaust manifold 4. Also, the engine body 1 is composed of a pair of intake and exhaust valves 8 and 9, a spark plug 11, a combustion chamber 16, and a piston 10. The swirling device 5 is inserted into the inside of the air cleaner 2 by a bolt 12 and a wing nut 13 (FIG. 1).

A diesel engine is provided with the engine body 1 which composes of a pair of intake and exhaust valves 8 and 9 (not shown), an injection nozzle 14, a glow plug 15, and the combustion chamber 16 and piston 10 (FIG. 3).

In operation, when the pistons 10 and intake valves 8 move downward, air flow filtered by the air cleaner element 17 is swirled by the swirling devices 5, respectively, due to a reduced pressure in the combustion chamber 16. At this time, in the carburetor 7 of the gasoline engine, fuel particles are gathered in the center of the swirling air flow for causing fuel and air to uniformly mix. And the swirling air flow center moves very fast so that the fuel does not adhere to the wall of the intake conduit and results in good engine and accelerator pedal response. Also, the swirling air flow is continuously maintained in the combustion chamber 16 so that the swirling air flow is continuously maintained in the exhaust manifold 4. Therefore, in the combustion chamber 16, the flame is scattered very well and the fuel is completely combusted for preventing noise, vibration and abrasion thereby causing longer engine life and stronger engine power.

Figure 4:
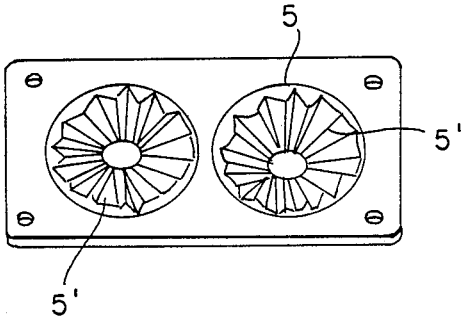
FIG. 4 is a front view of an additional swirling device for insertion between a carburetor and an intake manifold.

As shown in FIG. 4, additional swirling devices 5 having a plurality of vanes 5,, respectively, can be added in the portion between the carburetor 7 and intake manifold 3 in the same direction for increasing the swirling air flow force which may be reduced while the swirling air passes the carburetor 7.

Figure 5:
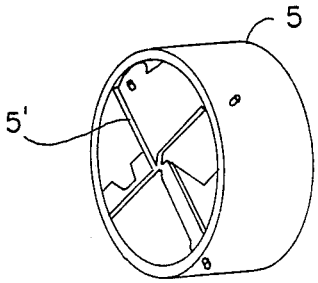
FIG. 5 is a perspective view of an another additional swirling device for insertion into an intake manifold entrance.

Another swirling device 5 (FIG. 5) is inserted into the intake manifold 3 of the gasoline injection type engine and the diesel engine in the same direction for improving the swirling air flow force.

Figure 6:
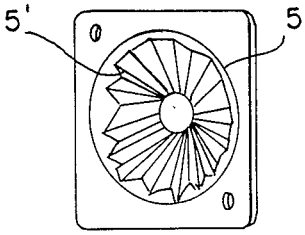
FIG. 6 is a front view of further a swirling device for insertion into an exhaust manifold entrance.

As shown in FIG. 6, a further swirling device 5 is inserted into the exhaust manifold entrance 4 in the same direction for improving the swirling of the exhaust gas. Furthermore, the swirling exhaust gas prevents back-pressure thereby resulting in complete exhaustion and stronger intake force.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. An air flow system for an internal combustion engine which comprises:

a cylindrical air cleaner, said cylindrical air cleaner divided into a centrally disposed air swirling zone and a laterally disposed filter zone, and a flexible swirling device disposed in said air swirling zone, said flexible swirling device including a centrally disposed hub member provided with a pluralituy of flexible vane members which extend radially outwardly from said hub member toward the filter zone and flex in reponse to increased air flow, whereby when air is introduced through said filter zone and into said air swirling zone, a strong swirling force is generated which is retained by the reduced resistance caused by the flexible nature of the vane members.

2. The air flow system of claim 1, further comprising a second swirling device near the intake manifold entrance to provide an air swirl in the same direction as said first air swirling device.

3. The air flow system of claim 1, further comprising a second swirling device near the exhaust manifold entrance to provide an air swirl in the same direction as said first air swirling device.

4. The air flow system of claim 1, wherein said engine is a gasoline or diesel engine.

5. The air flow system of claim 1, wherein said swirling device includes a central portion spaced from an opening in the bottom of said air cleaner and said vanes extend from said central portion toward said bottom of said air cleaner whereby said swirling device surrounds said opening in the bottom of said air cleaner.

6. The air flow device of claim 1, wherein said vanes are disposed inside of said air cleaner element.

7. The air flow device of claim 5, wherein said swirling device is formed from a single piece of metal.

* * * * *